US005543814A

United States Patent [19]

Jenness, Jr.

[11] Patent Number: 5,543,814

[45] Date of Patent: Aug. 6, 1996

[54] DIELECTRIC-SUPPORTED ANTENNA

[76] Inventor: James R. Jenness, Jr., 1653 Dogwood Cir., State College, Pa. 16803

[21] Appl. No.: 401,882

[22] Filed: Mar. 10, 1995

[51] Int. Cl.[6] ..... H01Q 19/12; H01Q 19/14

[52] U.S. Cl. ..... 343/840; 343/781 R; 343/872; 343/873

[58] Field of Search ..... 343/840, 781 P, 343/781 R, 912, 785, 786, 781 CA, 872, 873; H01Q 19/12, 19/14

[56] References Cited

U.S. PATENT DOCUMENTS

| | | | |
|---|---|---|---|
| 2,698,901 | 1/1955 | Wilkes | 343/781 P |
| 2,750,588 | 6/1956 | Hennessey | 343/781 P |
| 2,775,760 | 12/1956 | Brown et al. | 343/781 P |
| 3,545,583 | 7/1973 | Herbert | 343/742 |
| 3,611,396 | 10/1971 | Jones | 343/776 |
| 4,188,632 | 2/1980 | Knox | 343/753 |
| 4,482,513 | 11/1984 | Auletti | 264/39 |
| 4,636,801 | 1/1987 | Myer | 343/781 CA |
| 4,783,665 | 11/1988 | Lier et al. | 343/786 |
| 5,057,844 | 10/1991 | Rothstein | 342/51 |
| 5,426,443 | 6/1995 | Jenness, Jr. | 343/781 P |

FOREIGN PATENT DOCUMENTS

| | | |
|---|---|---|
| 56-122508 | 9/1981 | Japan . |
| 170502 | 3/1960 | Sweden . |

*Primary Examiner*—Hoanganh Le

[57] ABSTRACT

A dielectric body 20 with a dielectric constant near that of air has a surface 18, a portion of a paraboloid of revolution about an axis 9—9. A layer 15 of electrically conducting material is shaped by surface 18 to the form of an antenna reflector for transmitting electromagnetic radiation, or for receiving electromagnetic radiation indicated by arrows 50. A mating body 30 covers conductive layer 15. Dielectric body 20 has a protrusion 17 that mates with a horn 40 at a specified position relative to conductive layer 15, with horn axis 8—8 perpendicular to paraboloid axis 9—9.

2 Claims, 4 Drawing Sheets

DIELECTRIC-SUPPORTED ANTENNA

BACKGROUND OF THE INVENTION

1. Field of the Invention

The present invention relates to novel reflector structures in general, and in particular to antenna systems for microwave and millimeter wave electromagnetic radiation.

2. Description of the Prior Art

When a reflector operates as a transmitting antenna, a radiation feed, horn, or other component associated with an electromagnetic wave transmitting device is placed on its axis. The reflector is a concave paraboloid; it collimates the electromagnetic waves coming from the transmitting device.

When a reflector operates as a receiving antenna, it collects incoming electromagnetic waves and directs them to a component such as a horn associated with an electromagnetic wave receiving device.

Auletti (U.S. Pat. No. 4,482,513) forms microwave lenses of foam. He brings the effective dielectric constant to the desired value by mixing aluminum flakes in foam resin before pouring it into a lens mold. His invention is for refracting antennas rather than reflecting antennas.

Myer (U.S. Pat. No. 4,636,801) takes advantage of the high strength-to-weight ratio of a foamed polymer material, but does not make use of its low dielectric constant. His primary reflector is a metal layer bonded to a concave paraboloidal surface on a foam body. The foam is behind the reflector; the reflecting surface is exposed. A secondary reflector also has an exposed reflecting surface with foam behind a metal layer. The secondary reflector is supported by spider legs attached to the foam body of the primary reflector. Major portions of Myer's description and claims are devoted to the spider legs. Fabrication of the assembly requires skilled hand labor to achieve precise placement of the spider legs and secondary reflector relative to the primary reflector. After the spider legs and secondary reflector are set in place, the assembly must remain undisturbed for a period of time to allow an adhesive to form a bond between the parts.

Rothstein (U.S. Pat. No. 5,057,844) recognizes the benefit of protecting a metal antenna with a material of low dielectric constant. He sandwiches a flat strip antenna between flat pieces of polystyrene foam. The foam pieces do not shape the antenna; they merely enclose it for protection from a corrosive environment.

Knox (U.S. Patent No. 4,188,632) shows a secondary reflector or splash plate attached to a dielectric body in front of a waveguide. This subassembly is only part of a larger system that includes a primary reflector which Knox does not show. The splash plate blocks a portion of the primary reflector; a small splash plate is desirable. The dielectric body acts as a lens to change the directions of waves reflected by the splash plate, making possible the use of a smaller splash plate. A foam with a low dielectric constant would require a larger splash plate, defeating Knox's purpose. Knox shows a rod-like extension from the dielectric body, continuing with a tapered portion. It is a long slender member deeply inserted in a tightly-fitting waveguide. Its purpose is to match the impedance from air in the waveguide to the external body with a higher dielectric constant. Care is required to avoid breaking off this member in the process of inserting it into the waveguide. This does not facilitate rapid assembly in a manufacturing operation. Regardless of the speed of assembling the waveguide/splash plate subassembly, Knox's dielectric extension does not key the location of the waveguide/splash plate subassembly relative to a primary reflector.

Iida (Japanese Patent No. 56-122,508) describes a horn/waveguide subassembly for mounting in front of a primary reflector. Iida does not show the primary reflector or mechanical keys for locating the subassembly relative to it. Iida's subassembly performs a function similar to that of Knox. Iida shows a dielectric wave director that serves as an extension of a horn. This dielectric body directs waves by internal reflection, confining them within the dielectric in transit from the metal horn to a convex subreflector. The convex subreflector changes the wavefront directions to enable reflected waves to pass through the dielectric/air interface at angles away from the critical angle for total internal reflection. Total internal reflection requires a dielectric constant greater than that of air, so a foam dielectric would not serve Iida's purpose.

Jones (U.S. Patent No. 3,611,396) shows a foam body in the form of a horn with corrugated walls and a flat septum between top and bottom sections. The surfaces are plated with metal by a complex process, the subject of another patent application. The corrugated surfaces are not compatible with rapid attachment of layers of low-cost electrically conducting materials such as foils or wire fabrics.

Lier et al. (U.S. Patent No. 4,783,665) describe dielectric horns that serve mainly to support metal grid structures in front of metal horns. Such a modified horn functions in a manner similar to that of a corrugated horn.

Berg (Swedish Patent No. 170,502) shows foam between the concave primary reflector and the convex secondary reflector of a Cassegrainian antenna. The foam does not extend into a horn at the center of the primary reflector. The horn is attached to the primary reflector. The reflectors are pre-formed metal shells. Berg does not disclose a fabrication process, but the assembly shown in his single drawing could be fabricated by foaming in place, holding the primary and secondary reflectors in their required positions relative to each other and allowing a foaming resin to expand between them. In this process the foam is shaped by the pre-formed reflector shells. Berg does not show any off-axis antenna configurations, and does not teach the lamination of metal foils, electrically conducting polymer films, wire screens, or electrically conducting fabrics on a pre-formed foam body.

Jenness (U.S. Patent Application No. 08/182,778, allowed Jan. 23, 1995 uses a foam body with surfaces in the forms of a primary reflector, a secondary reflector and the inner surface of a horn. With layers of conductive material on the reflector surfaces and a horn mating with the horn-shaped surface, the assembly functions as an antenna. All claims are for antennas with axially symmetric coaxial reflectors and horn.

SUMMARY OF THE INVENTION

The present invention is not limited to axially symmetric coaxial antenna configurations. The principal component is a body of dielectric foam material with an external surface in the form of an antenna reflector. When such a surface is covered by a layer of electrically conducting material, it forms a microwave reflector analogous to a back-surface mirror. The surface of the foam body shapes and supports the reflector thus formed, and occupies space between it and other antenna components. No other structure is required to hold such a reflector at its proper location relative to a device for transmitting or receiving electromagnetic waves. The foam body has low dielectric loss and a low dielectric constant, so there is very little change in the amplitude or direction of electromagnetic waves passing through it. The geometry of the antenna system differs very little from that of a conventional system with air in front of the reflector. No spider legs or other dielectric discontinuities clutter the reflector aperture. The form and dimensions of the dielectric body maintain the required positions of the reflector and electromagnetic wave transmitting or receiving device relative to each other.

The advantages of the invention are light weight and economy of manufacture. The dielectric body can be molded at low cost. Its size and shape ensure precise placement of the reflector and a horn or other component associated with an electromagnetic wave transmitting or receiving device in contact with its external surfaces. No special skills are required for assembly.

DESCRIPTION OF THE PREFERRED EMBODIMENTS

Figure 1:
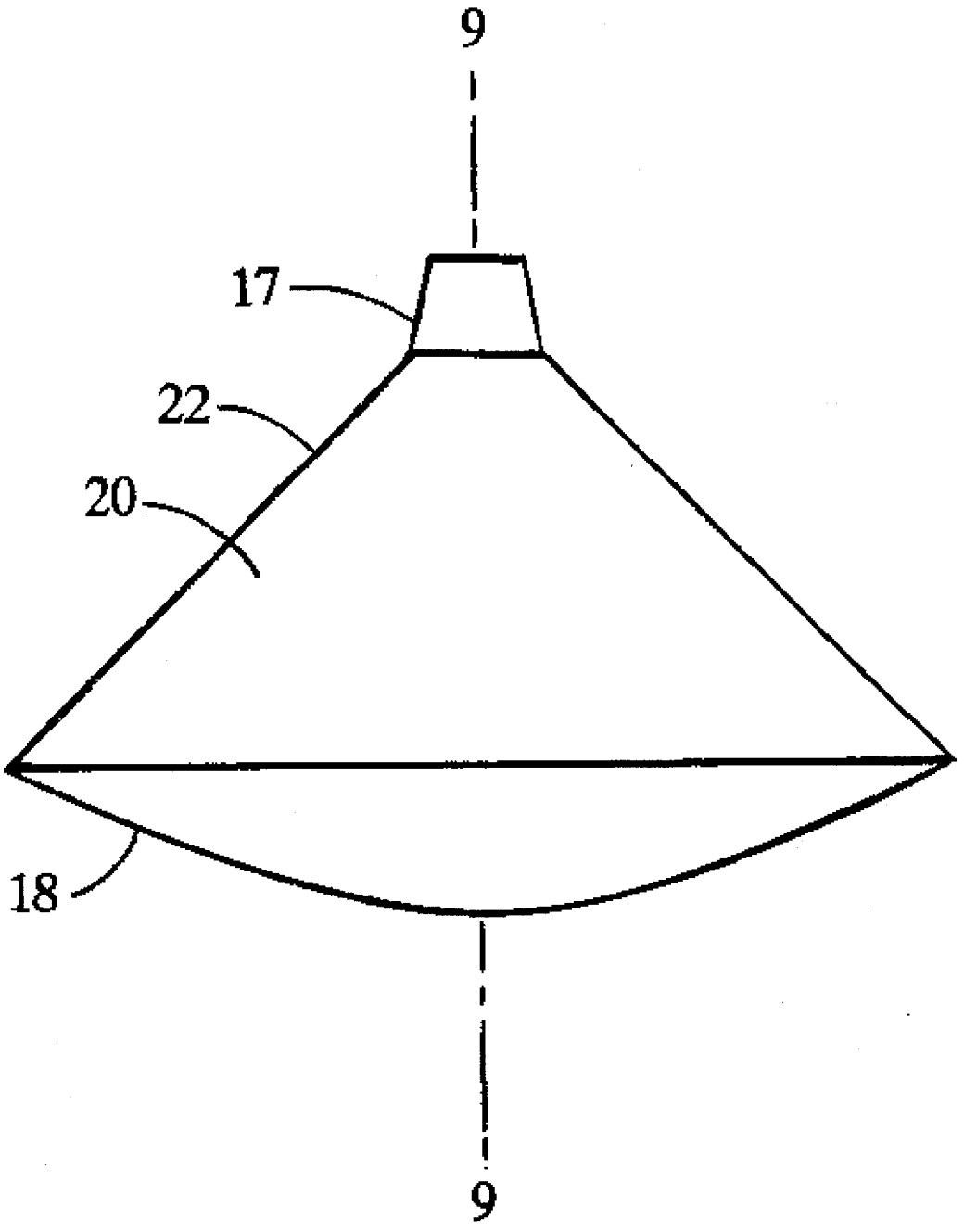
FIG. 1 is a side view of a electric body with a reflector surface and a horn-shaped protrusion.

FIG. 1 shows a side view of a dielectric body 20. Its back surface 18 is a paraboloid of revolution about an axis 9—9. The form of a front surface 22 is not critical to the operation of the device. It is shown as a truncated cone, but it can have any practical or aesthetically pleasing shape. A protrusion 17 extends beyond surface 22; its axis coincides with axis 9—9 of paraboloidal surface 18.

Figure 2:
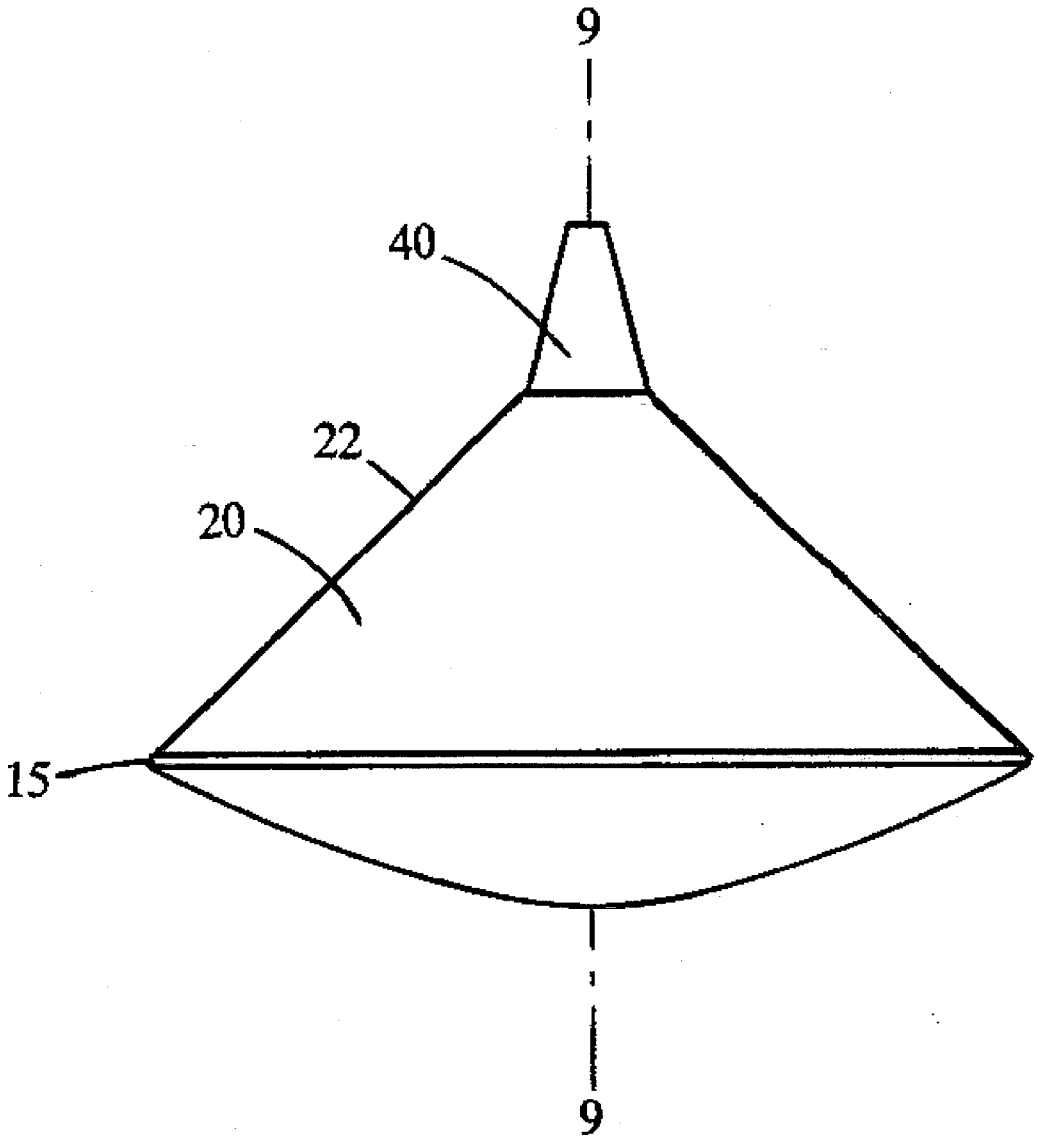
FIG. 2 shows the body of FIG. 1 with attachments.

FIG. 2 shows body 20 of FIG. 1 with a layer 15 of electrically conducting material attached, forming a reflector. A horn 40 associated with a device for transmitting or receiving microwave or millimeter wave electromagnetic radiation fits over protrusion 17 of FIG. 1. The axial dimension of body 20 places horn 40 at a specified position relative to conducting layer 15. In the most general case the reflector can have an empirically designed surface of revolution about axis 9—9 not described by conic-section equations. Its curvature can compensate for any refractive effect that may be caused by surface 22 of dielectric body 20. Of course some foamed polymers have a dielectric constant as low as 1.04, corresponding to a refractive index of 1.02. Such materials have very little refractive effect on microwave and millimeter wave radiation. If such a material is used for body 20, the form of the reflector surface will be the same as that in a conventional open antenna system.

Figure 3:
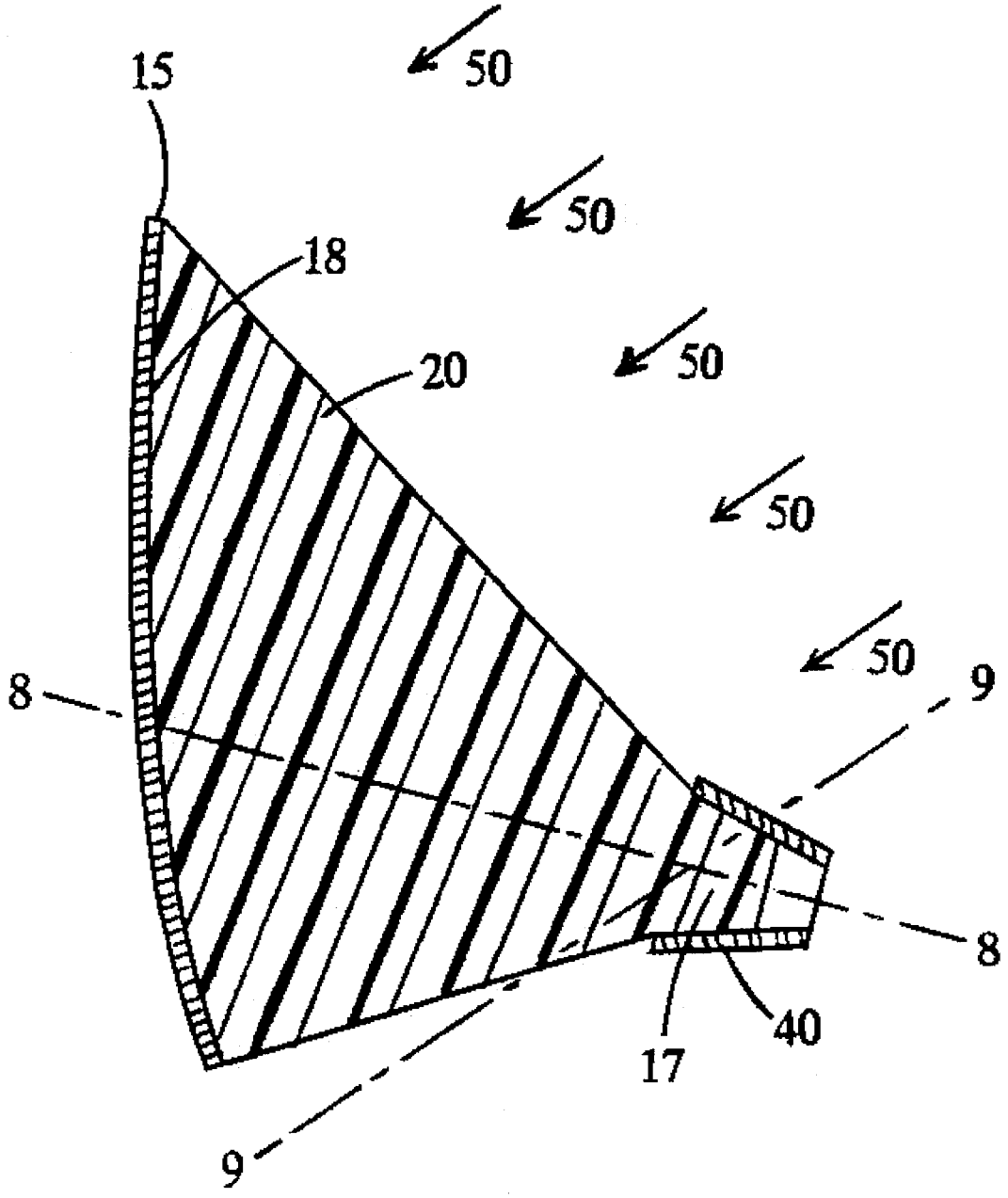
FIG. 3 is a cross-section through a dielectric body that supports an off-axis antenna assembly.

The configuration need not be symmetric; FIG. 3 shows a cross-section through an antenna with a horn outside the periphery of the primary reflector profile. Surface 18 of dielectric body 20 is an off-axis portion of a paraboloid of revolution about axis 9—9. Body 20 supports conducting layer 15 and horn 40 to form an antenna capable of transmitting or receiving radiation traveling parallel to axis 9—9. Horn 40, mating with protrusion 17 of body 20, does not obstruct the transmitting or receiving profile of the reflector formed by conducting layer 15. Horn axis 8—9 is co-planar with and at a specified angle from axis 9—9 of paraboloidal surface 18. The angle is chosen to project horn axis 8—9 through the centroid of the profile of surface 18. When the assembly operates as a receiving antenna, incoming rays indicated by arrows 50 are intercepted by conducting layer 15 and reflected toward horn 40. To receive radiation from a satellite in geosynchronous orbit over the earth's equator, the plane of axes 8—9 and 9—9 is vertical and oriented to include the line of sight to the satellite. Axis 9—9 is inclined above horizontal, parallel to the line of sight.

Figure 4:
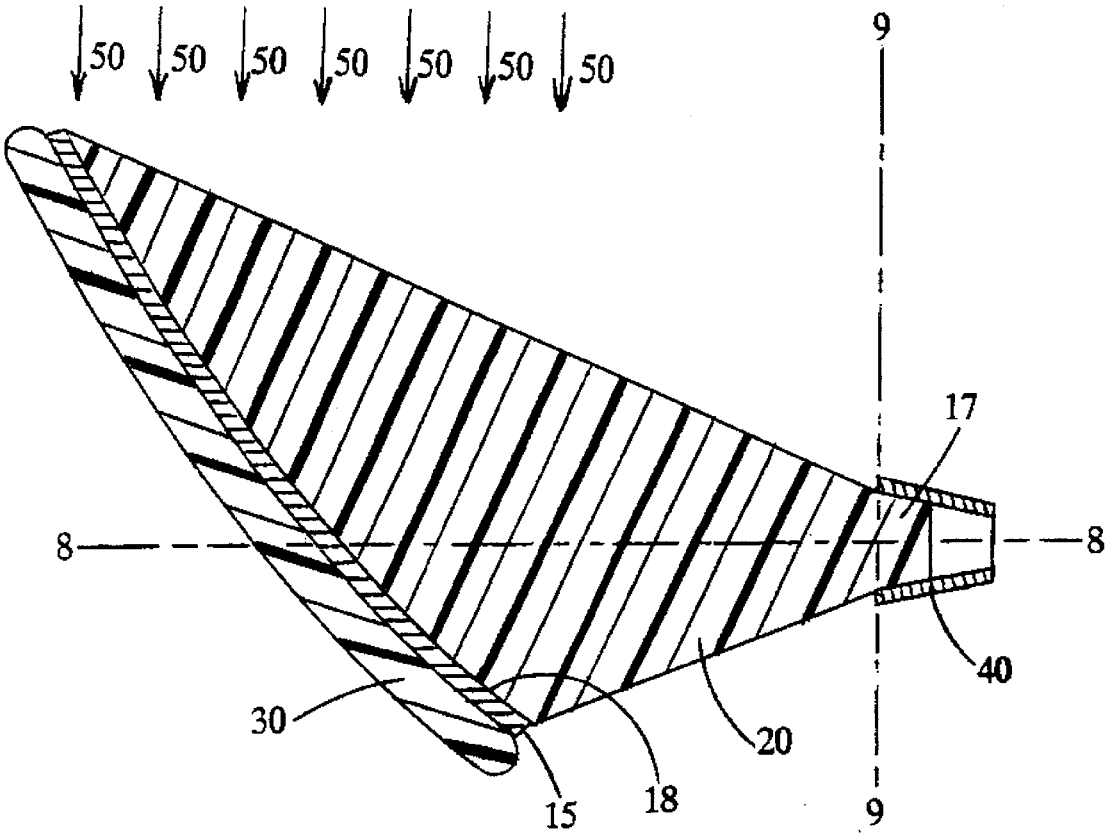
FIG. 4 is a cross-section through a dielectric body that supports a 90° off-axis antenna assembly.

FIG. 4 shows an alternative off-axis configuration for a receiving antenna. Axis 8—9 of horn 40 is co-planar with and perpendicular to axis 9—9 of paraboloidal surface 18 on dielectric body 20. Conductive layer 15 is formed by surface 18 to the shape of an off-axis paraboloidal reflector. A protective foam body 30 mates with the back surface of conductive layer 15. To receive radiation from a satellite in geosynchronous orbit, indicated by arrows 50, horn axis 8—9 is horizontal and perpendicular to the line of sight to the satellite. Axis 9—9 of paraboloidal surface 18 is brought to the required line-of-sight angle above horizontal by rotating the assembly about horn axis 8—9.

Body 20 can be of any material with low dielectric loss and a low dielectric constant. Foamed polymers are appropriate because of their moldability for economical manufacture. The light weight of a foam antenna provides advantages for shipment and handling.

Layer 15 can be metal foil, wire screen, electrically conducting plastic, woven, knit, or non-woven electrically conducting fabric, or any other electrically conducting material. It can be coats of electrically conducting paint on surface 18 of body 20 or the mating surface of body 30 of FIG. 4. It can also be an electrically conducting adhesive in the interstice between the mating reflector-forming surfaces of bodies 20 and 30.

The overall advantages of the invention include elimination of webs or spider lees to support a horn, light weight, and simple form compatible with economical manufacture. Dielectric body 20 and protective body 30 can be molded of light-weight low-dielectric foamed polymer materials at low cost. The molded foam components and the mating horn of an electromagnetic wave transmitting or receiving device fit together to place them at their required positions relative to each other. The components can be assembled rapidly with the required precision by unskilled labor.

This invention has been described in its presently contemplated best mode, with several alternatives. It is susceptible to numerous modifications, modes, and embodiments without the exercise of further invention.

I claim:

1. An antenna structure comprising:

a body composed of a rigid dielectric material having a dielectric constant approximately equal to that of air, having a surface shaped as a portion of a surface of revolution, having the form of an antenna reflector and a protrusion having a surface shaped as a portion of the inner surface of a horn for transmitting or receiving microwave or millimeter wave electromagnetic radiation, the axis of said protrusion being co-planar with and perpendicular to the axis of said surface of revolution, a layer of electrically conducting material in contact with said portion of said surface of revolution of said body, shaped by said surface to the form of an antenna reflector, and a horn associated with an electromagnetic wave transmitting device or an electromagnetic wave receiving device mating with said protrusion of said body, said body having form and dimensions to place said layer of electrically conducting material at a position relative to said horn such that the assembly can function as an antenna reflector system for transmitting or receiving microwave or millimeter wave electromagnetic radiation.

2. The antenna structure of claim 1 wherein said layer of electrically conducting material is held between said surface of revolution of said dielectric body and a mating surface of a second body.

* * * * *